US009699547B2

(12) United States Patent
Akino

(10) Patent No.: US 9,699,547 B2
(45) Date of Patent: Jul. 4, 2017

(54) NON-DIRECTIONAL MICROPHONE

(71) Applicant: Hiroshi Akino, Kanagawa (JP)

(72) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 15/165,653

(22) Filed: May 26, 2016

(65) Prior Publication Data

US 2016/0366508 A1 Dec. 15, 2016

(30) Foreign Application Priority Data

Jun. 9, 2015 (JP) ..... 2015-116266

(51) Int. Cl.

| | |
|---|---|
| ***H04R 3/00*** | (2006.01) |
| ***H04R 1/22*** | (2006.01) |
| ***H04R 9/08*** | (2006.01) |
| ***H04R 1/08*** | (2006.01) |
| ***H04R 1/32*** | (2006.01) |

(52) U.S. Cl.

CPC ..... *H04R 1/222* (2013.01); *H04R 1/08* (2013.01); *H04R 1/326* (2013.01); *H04R 9/08* (2013.01); *H04R 2410/07* (2013.01)

(58) Field of Classification Search

CPC ..... H04R 1/222; H04R 1/08; H04R 1/326
See application file for complete search history.

(56) References Cited

U.S. PATENT DOCUMENTS

2010/0002543 A1* 1/2010 Schlosser ..... H04R 19/005 367/181
2012/0230523 A1* 9/2012 Ehrlund ..... H04R 19/04 381/174
2012/0263332 A1* 10/2012 Akino ..... H04R 19/04 381/355

FOREIGN PATENT DOCUMENTS

JP 2009-60391 3/2009

* cited by examiner

*Primary Examiner* — Simon King
(74) *Attorney, Agent, or Firm* — Whitham, Curtis & Cook, P.C.

(57) ABSTRACT

A non-directional microphone includes a housing, a microphone unit attached to the housing, and including a diaphragm that receives a sound wave, and a connector portion to which a cable connector including a cable that transmits an audio signal from the microphone unit is connected, and a pressure equalization opening that allows a back-side space of the diaphragm in the housing and an outer space to communicate is provided in the connector portion. In the non-directional microphone, the communication between the back-side space of the diaphragm and the outer space through the pressure equalization opening is cut off when the cable connector is connected to the connector portion, and the back-side space of the diaphragm communicates into the outer space through the pressure equalization opening when the cable connector is disconnected from the connector portion.

6 Claims, 4 Drawing Sheets

NON-DIRECTIONAL MICROPHONE

BACKGROUND OF THE INVENTION

Technical Field

The present invention relates to a microphone, and more specifically relates to a non-directional microphone including an opening portion for pressure equalization.

Background Art

Typically, a non-directional microphone has a diaphragm that is driven by a pressure difference between an outer space (outside air) and an inner space (air chamber) of a housing. Therefore, a space at the back of the diaphragm in the housing in the non-directional microphone is a closed space not communicating into the outer space (outside air).

Meanwhile, in actual designing and productizing, elements such as atmospheric pressure change are taken into account. When the atmospheric pressure is changed, the diaphragm is displaced due to the pressure difference between the outside and the air chamber. If this displacement is large, the diaphragm is broken down. To eliminate such a pressure difference between the outside and the air chamber, a microphone having a structure in which a small opening portion is provided in the housing, and the back-side space of the diaphragm and the outer space communicate through the opening portion is known, for example. The microphone having the structure makes inside/outside pressures of the microphone equal by allowing the back-side space of the diaphragm and the outer space to communicate. The structure making the inside/outside pressures of the microphone equal as described above is called pressure equalization (see JP 2009-060391 A), and the opening portion for the pressure equalization is called pressure equalization opening.

However, when the microphone described in JP 2009-060391 A is used in rainy weather, water drops (rain drops and the like) easily enter the inside of the microphone through the pressure equalization opening. The water drops causes corrosion of internal parts and the like, and becomes a cause of breakdown. Further, if winds and the like are applied to the pressure equalization opening portion at the time of use, a wind noise occurs due to pressure change.

SUMMARY OF INVENTION

An object of the present invention is to provide a non-directional microphone that can prevent entry of foreign matter through a pressure equalization opening at the time of use.

According to an aspect of the present invention, there is provided a non-directional microphone including: a housing; a microphone unit attached to the housing, and including a diaphragm that receives a sound wave; and a connector portion to which a cable connector including a cable that transmits an audio signal from the microphone unit is connected, wherein a pressure equalization opening that allows a back-side space of the diaphragm in the housing and an outer space to communicate is provided in the connector portion, and the communication between the back-side space of the diaphragm and the outer space through the pressure equalization opening is cut off when the cable connector is connected to the connector portion, and the back-side space of the diaphragm communicates into the outer space through the pressure equalization opening when the cable connector is disconnected from the connector portion.

DESCRIPTION OF PREFERRED EMBODIMENTS

A non-directional microphone of the present embodiment includes a housing, a microphone unit attached to the housing and including a diaphragm that receives a sound wave, and a connector portion to which a cable connector including a cable that transmits an audio signal from the microphone unit is connected. In the connector portion, a pressure equalization opening that allows a back-side space of the diaphragm in the housing and an outer space to communicate is provided. In such a non-directional microphone, when the cable connector is connected to the connector portion, communication between the back-side space of the diaphragm and the outer space through the pressure equalization opening is cut off, and when the cable connector is disconnected from the connector portion, the back-side space of the diaphragm communicates into the outer space through the pressure equalization opening.

Hereinafter, an embodiment of the present invention will be described with reference to the drawings.

Figure 1:
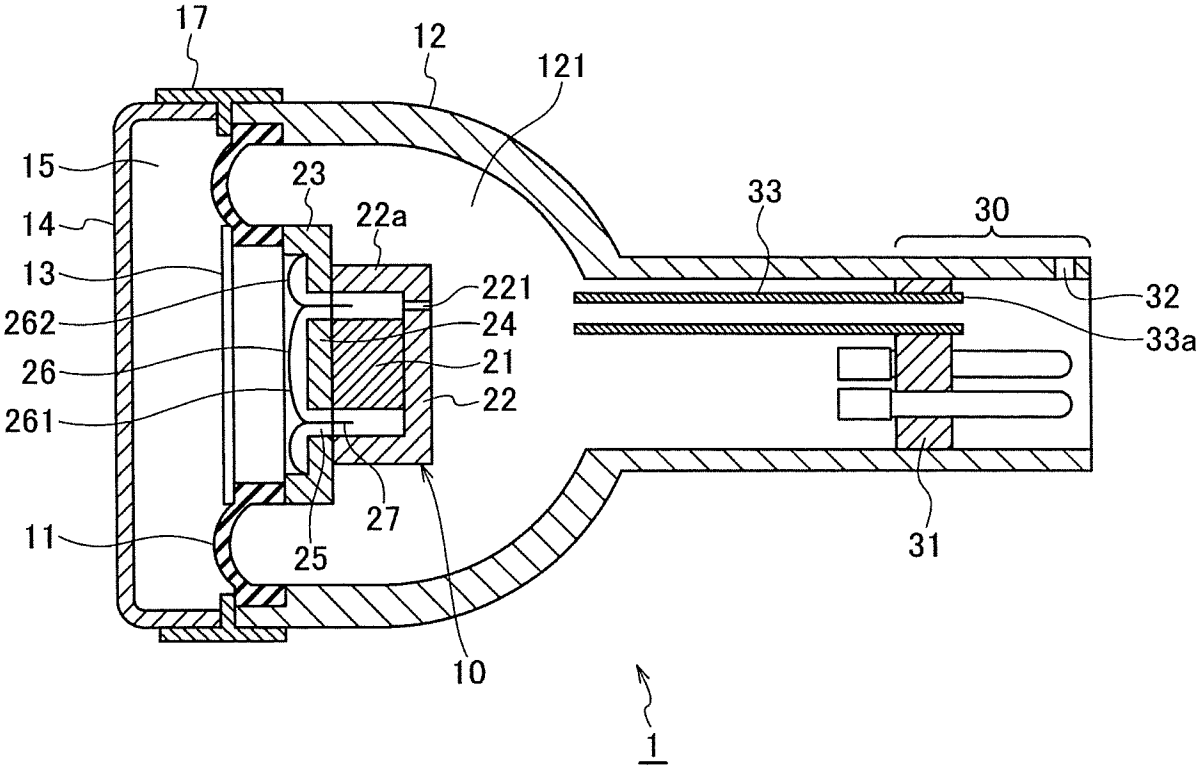
FIG. 1 is a longitudinal sectional view of a non-directional microphone according to an embodiment of the present invention.

In FIG. 1, a microphone 1 includes a case 12 as a housing, a shock mount 11 attached to a front end portion of the case 12, and a microphone unit 10 attached through the shock mount 11. Further, a microphone connector portion 30 to which an output connector 40 is connected is provided in the other end side of the microphone 1.

(Microphone Unit)

Directivity of the microphone unit 10 is non-directional. A dynamic microphone is robust and does not require a power source, and is thus widely used for interviews outside and the like. Especially, a non-directional dynamic microphone is operated by applying a sound wave only to a front side (the left side in FIG. 1) of the microphone unit 10, and thus has an advantage that a wind noise is less likely to occur when an air flow is applied to the microphone. Therefore, the non-directional dynamic microphone is often used under the condition of severe weather, such as relay broadcasting at the time of disaster.

The diaphragm of the non-directional microphone vibrates by a pressure difference between a front-side space of the diaphragm, that is, an outer space (outside air), and a back-side space of the diaphragm, that is an inner space (air chamber) of the case 12. Therefore, the diaphragm detects a sound pressure applied to the front side of the diaphragm as an audio signal. Therefore, ideally, an inner space 121 is required not to communicate into the outer space so that the sound wave is not propagated into the inner space 121 of the case 12.

Meanwhile, when pressure equalization is lost in the non-directional microphone, the diaphragm is more largely displaced than usual due to the inside/outside pressure difference. Therefore, this displacement may become a cause of breakdown such as damage of the diaphragm. Therefore, a microphone having a structure that holds the pressure equalization is favorable so that the diaphragm in the microphone unit 10 is not displaced due to the pressure difference even if the atmospheric pressure is changed when the microphone 1 is used on the top of a mountain or in the sky.

The microphone in the present embodiment has a structure that connects the inner space of the microphone 1 to the outer space through a pipe 33 to allow the inner space of the case 12 and the outer space to communicate in order to hold the pressure equalization. Hereinafter, the pipe 33 that serves a function to equalize the pressures inside and outside the microphone 1 is called "pressure equalization pipe".

The microphone unit 10 is a dynamic-type microphone unit having the diaphragm, a coil, and a permanent magnet as principal configuration elements. The microphone unit 10 converts vibration of the diaphragm 26 due to the sound wave such as a voice into an electric signal. Hereinafter, a configuration of the microphone unit 10 will be described.

The microphone unit 10 includes a yoke 22. The yoke 22 has a flat circular plate shape. A disk or column-shaped magnet (permanent magnet) 21 is fixed to the center in an inner bottom surface of the yoke 22. The magnet 21 is magnetized in a thickness direction (in the right and left direction in FIG. 1). The thickness (height) dimension of the magnet 21 is the same as the height of an inner peripheral surface of a peripheral wall 22*a* of the yoke 22, and an upper end surface of the magnet 21 and an upper end surface of the peripheral wall 22*a* of the yoke 22 are on the same plane.

A ring yoke 23 is fixed to the upper end surface of the peripheral wall 22*a* of the yoke 22. Further, an elongate hole portion 221 communicating into an inside (back-side) space of the diaphragm 26 is formed in the inner bottom surface of the yoke 22. The number of hole portions 221 is arbitrary.

A disk-like pole piece 24 is fixed to the upper end surface of the magnet 21. An upper end surface of the pole piece 24 and an upper end surface of the ring yoke 23 are on the same plane. A concentric circular gap 25 is formed between an inner peripheral surface of the ring yoke 23 and an outer peripheral surface of the pole piece 24 with a fixed width. The pole piece 24, the ring yoke 23, and the yoke 22 configure a magnetic circuit that allows a magnetic flux emitted from the magnet 21 to pass. That is, the magnetic flux emitted from the magnet 21 passes the pole piece 24, reaches the ring yoke 23 through the gap 25, further passes the yoke 22, and returns to the magnet 21. Therefore, a magnetic field is formed in the gap 25.

A voice coil 27 formed a narrow conductive wire is wound in a cylindrical manner is arranged in the gap 25 to cross the magnetic field formed in the gap 25. The voice coil 27 is attached to the diaphragm 26 made of a film-like material.

More specifically describing configurations of the diaphragm 26 and the voice coil 27, the diaphragm 26 has a center dome portion 261, and a sub dome portion 262 formed in a ring shape along an outer periphery of the center dome portion 261. The sub dome portion 262 is integrally formed with the center dome portion 261. To elastically support the center dome portion 261, a cross section shape of the sub dome portion 262 is a dome shape. One end side of the voice coil 27 is fixed near a boundary of the center dome portion 261 and the sub dome portion 262. Conductive wires of both ends of the voice coil 27 are connected to electrodes of the microphone connector portion 30, for example, a second pin and a third pin. The conductive wires of the both ends of the voice coil 27 may be connected to output circuits such as transformers.

In the microphone unit 10 having the above-described configuration, the diaphragm 26 and the voice coil 27 vibrate when the diaphragm 26 receives various sound waves such as a voice. In the microphone unit 10, the voice coil 27 generates audio signals according to Fleming's right hand rule when the voice coil 27 vibrates in the magnetic circuit. On the occasion of the audio signals generation, the sound waves are electroacoustically converted, and audio signals are output from the conductive wires of the both ends of the voice coil 27 to an external device through the signal pins of the microphone connector portion 30.

The shock mount 11 is configured from a material having elasticity to hold the microphone unit 10 in the case 12, and prevent transmission of vibration from the case 12 to the microphone unit 10. Further, a head cover 14 is attached to the front end portion of the case 12 to sandwich the shock mount 11 between the head cover 14 and the case 12. The head cover 14 is attached to cover the front end portion of the case 12, and is attached to the front end portion of the microphone case 12 with a ring-like joint member 17. This head cover 14 plays a role to prevent the outside air from directly blowing on the diaphragm 26 of the microphone unit 10 and prevent occurrence of the wind noise.

In the present embodiment, a sound collecting space 15 is formed between the front (in the left direction in FIG. 1) of the diaphragm 26 of the microphone unit 10 and the head cover 14. Further, an air chamber is formed in a space between the yoke 22 and the ring yoke 23 in the back (in the right direction in FIG. 1) of the diaphragm 26. This air chamber communicates into the inner space 121 of the case 12 through the hole portion 221 of the yoke 22, and further communicates into the outer space (outside air) of the case 12 through the pressure equalization pipe 33.

Further, in the microphone 1 having the above-described configuration, when vibration in the right and left direction in FIG. 1 is applied due to dropping of the microphone 1 or rapid shake, the shock mount 11 is relatively displaced from the case 12, and offsets the vibration. Accordingly, the microphone unit 10 can prevent propagation of unexpected vibration.

(Microphone Connector Portion)

Next, a configuration of the microphone connector portion 30 will be described. The microphone connector portion 30 is a portion to be connected with the output connector 40 (cable connector) described below. In this example, as the microphone connector portion 30, a round latch lock connector (JEITA [Japan Electronics and Information Technology Industries Association] RC-5236) is used as the output connector for microphone.

The microphone connector portion 30 includes a connector base 31 provided inside and at an end side of the case 12, three signal pins as connector pins and the pressure equalization pipe 33 attached to the connector base 31. Further, a hole 32 is formed in an end portion of the case 12 for being connected with the round latch lock connector.

A printed circuit board is layered and arranged on one surface side of a base body made of a columnar electrical insulator in the connector base 31. The connector base 31 is configured such that a synthetic resin such as polybutylene terephthalate (PBT) is formed in a columnar manner. The connector base 31 plays a role of a holding member that holds the three signal pins and the pressure equalization pipe 33. Four hole portions are formed in the connector base 31, and three pins including a first pin for grounding, a hot-side second pin of a signal, and a cold-side third pin of a signal are inserted into and fixed to three hole portions of the four hole portions. Further, the pressure equalization pipe 33 is inserted into and fixed to the other one hole portion of the connector base 31.

Base ends of the second pin and the third pin protrude toward the inner space 121 of the case 12. The conductive wires of the voice coil 27 are connected to the base ends. Further, tip ends of the second pin and the third pin protrude toward an outer space of the case 12, and are connected with connector electrodes of the output connector at the time of use.

The pressure equalization pipe 33 is a pipe having a narrow diameter that does not allow a sound wave in a principal band to pass. A base end side of the pressure equalization pipe 33 is open in the inner space 121 of the case 12. Further, the opening portion 33*a* at a tip end side of the pressure equalization pipe 33 is open to the outer space of the case 12. Therefore, the air inside the case 12 and the outside air communicate through an air hole of the pressure equalization pipe 33.

In the present embodiment, the opening portion 33*a* that is in contact with the outside air of the pressure equalization pipe 33 plays a role as the pressure equalization opening. That is, the pressure equalization opening is provided capable of ventilating the inside of the case 12 with the outside air from the microphone connector portion 30.

(Connection with Output Connector)

Next, a case of attaching/detaching the output connector 40 to/from the microphone 1 will be described with reference to FIGS. 2 and 3. Here, the output connector 40 is a typical round latch lock connector (RC-5236). A connector portion 42 to be connected to the microphone connector portion 30 is provided at one end side of a housing 41. The connector portion 42 includes groove portions into which the pins are inserted and terminals to be in contact with the pins in positions corresponding to the three pins (the first to third pins) of the microphone 1. Conductive wires of an output cord 43 extending from the other end side of the housing 41 are connected to the terminals of the connector portion 42. A latch portion 44 to be latched with the hole 32 is provided on a side surface of the connector portion 42 and a portion corresponding to the hole 32 of the microphone connector portion 30. The latch portion 44 is integral with a pressing portion 45 that protrudes from a side surface of the housing 41, and is biased outward from the side surface of the connector portion 42 with a spring in the housing 41. Therefore, the latch portion 44 is moved from the side surface of the connector portion 42 to an inner position when the pressing portion 45 is pushed in, and returns to the original position when the pushing in is cancelled.

Figure 2:
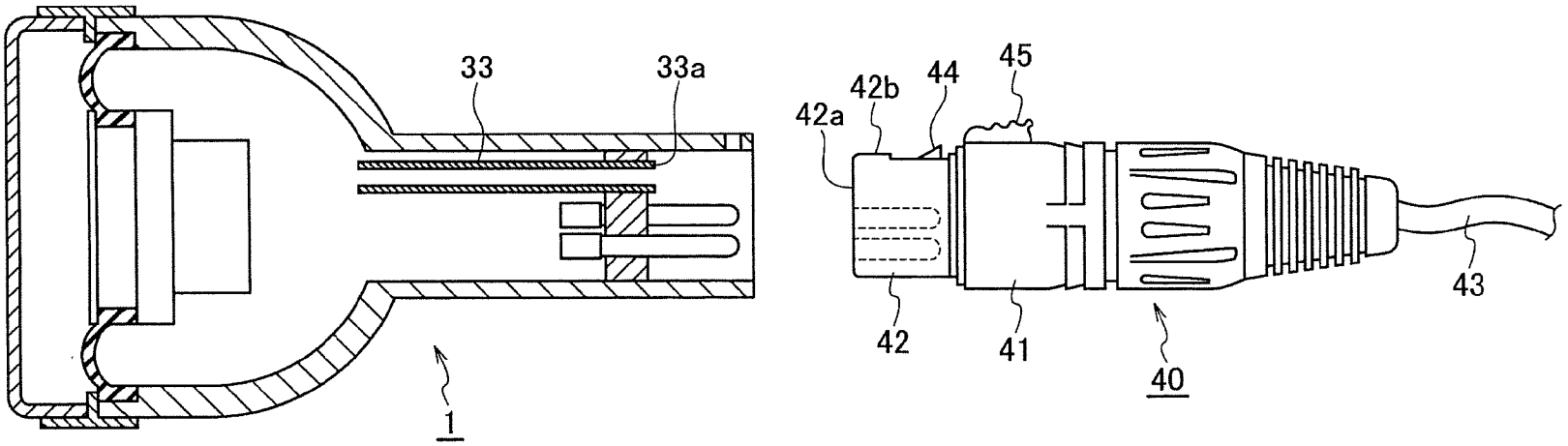
FIG. 2 is a diagram for describing a case in which a non-directional microphone is about to be connected to a cord-side connector.
Figure 3:
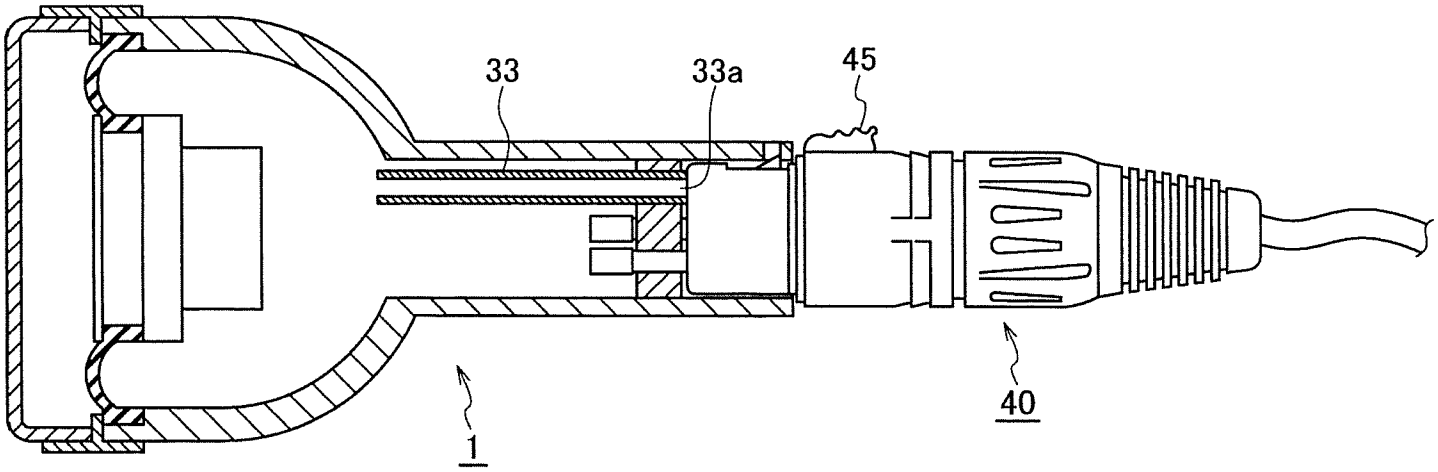
FIG. 3 is a diagram illustrating a state in which a non-directional microphone of the present embodiment is connected to a cord-side connector.

When the microphone 1 is used for recording or the like, the output connector 40 is inserted into the microphone connector portion 30 in a state where the corresponding portions of the microphone connector portion 30 and the output connector 40 are brought face to face with one another, as illustrated in FIG. 2, and is connected with the microphone connector portion 30, as illustrated in FIG. 3.

With the connection of the connector, the three pins of the microphone 1 are inserted into the corresponding groove portions of the output connector 40 and electrically connected with the terminals, and the hole 32 is engaged with the latch portion 44. Further, a plane portion 42*a* of the connector portion 42 is brought in contact with or is pressed against the opening portion 33*a* of the pressure equalization pipe 33 that is the pressure equalization opening of the microphone 1 to close the opening portion 33*a*.

That is, when the microphone 1 and the output connector 40 become such a connection state, the pressure equalization opening 33*a* of the microphone 1 is closed. Therefore, the microphone 1 according to the present embodiment can prevent entry of water droplets and wind from an outside at the time of use.

After the end of the use of the microphone 1, when the pressing portion 45 is pushed in, engagement of the hole 32 and the latch portion 44 is released. When the output connector 40 is pulled out of the microphone 1, the opening portion 33*a* of the pressure equalization pipe 33 is separated from the plane portion 42*a* of the connector portion 42 (see FIG. 2). In this way, the pressure equalization opening 33*a* of the microphone 1 is opened at the time of non-use of the microphone 1, and the inner space of the microphone 1 and the outside air communicate through the pressure equalization pipe 33.

Therefore, the microphone 1 of the present embodiment can maintain the pressure equalization state of the inner space of the microphone 1 by leaving the output connector 40 off the microphone 1 at the time of movement, even when the microphone 1 is moved to the top of a mountain or in the sky and used, for example. Further, the pressure equalization opening 33*a* is closed by the connection of the output connector 40 at the time of use of the microphone 1, and thus the water drops and wind from an outside do not enter the microphone unit 10. After the use of the microphone 1, the pressure in the microphone unit 10 can maintain an equivalent state to the outside by removal of the output connector 40.

Further, in the microphone 1 in the present embodiment, the pressure equalization opening (opening portion 33*a*) of the pressure equalization pipe 33 is closed by the plane portion 42*a* of the output connector 40 at the time of use. Therefore, wind and the like do not blow on the pressure equalization opening, and occurrence of a wind noise can be prevented. Further, such a configuration can prevent entry of the sound wave having a low frequency component to the microphone unit 10 through the pressure equalization pipe 33, and can prevent occurrence of a noise due to the low frequency.

As described above, a portion of the pressure equalization pipe 33, the portion being in contact with the outside air, is closed when the cord-side connector is inserted into the microphone at the time of use of the microphone 1, and thus the present embodiment can prevent entry of the water drops and wind to the inside of the microphone.

The above-described embodiment is an example, and various modifications can be made.

In the above-described embodiment, a configuration to cut off the communication between the inner space of the microphone (housing) and the outer space when the plane portion of the output connector is brought in contact with or is pressed against the opening portion of the pressure equalization pipe to close the pressure equalization opening has been described. However, such being brought in contact or being pressed is not necessarily required. That is, a configuration can be employed as long as the configuration cuts off communication between an inner space (a back-side space of a diaphragm) of a housing and an outer space through a pressure equalization opening when an output connector is connected to a microphone unit. Such a configuration can prevent entry of water droplets and wind from an outside at the time of use of the microphone.

Therefore, as another example, a ring-like sealing member made of silicone rubber may be provided on an inner peripheral surface of a case 12 to which an output connector is connected or an outer peripheral surface of the output connector. In this case, when the output connector is connected to the microphone unit, an inner space of a microphone connector portion is blocked by the output connector and the sealing member even if the plane portion of the output connector is not brought in contact with a pressure equalization opening portion of a pressure equalization pipe. Therefore, according to the present embodiment, communication between an inner space of the microphone unit and an outer space through the pressure equalization pipe is cut off at the time of use, and entry of water droplets and wind from an outside can be prevented.

As another example, a pressure equalization pipe 33 is not necessarily required. A configuration in which a hole portion serving as a pressure equalization opening is provided in a connector base 31 itself, and the pressure equalization opening of the connector base 31 is closed/opened by a plane portion of an output connector can be employed.

In the above-described embodiment, the configurations provided with a dynamic-type microphone as the microphone unit 10 have been exemplarily described. However, an embodiment is not limited to the above configurations. The electroacoustic conversion method is not especially limited as long as the microphone unit 10 has functions to receive sound waves such as a voice with a diaphragm, and to convert vibration of the diaphragm into an electrical signal.

(Reference Example)

For understanding the embodiments, a non-directional microphone having a configuration in which a pressure equalization opening is provided in a housing will be illustrated and described as a comparative example or a reference example.

Figure 4:
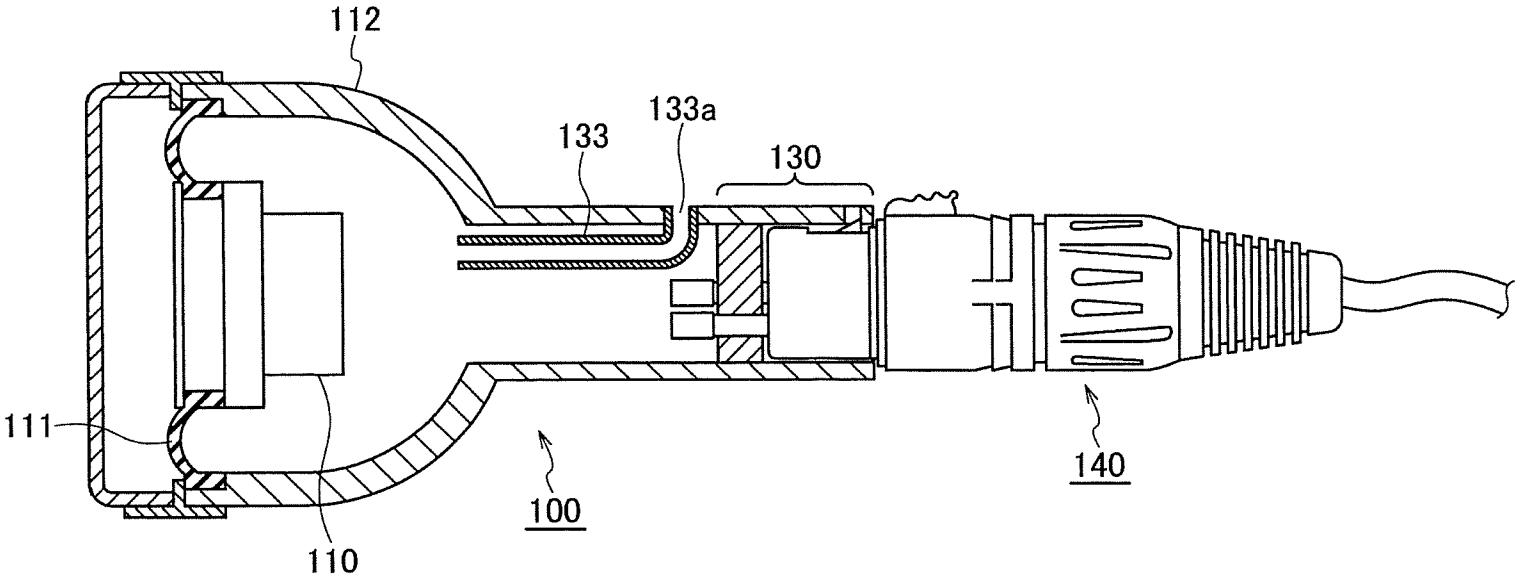
FIG.4 RELATED ART
FIG. 4 is a sectional view of a non-directional dynamic microphone as a reference example for comparison with the present embodiment.

In FIG. 4, a microphone 100 includes a case 112 as a housing, a shock mount 111 attached to a front end portion of the case 112, and a microphone unit 110 attached through the shock mount 111. The microphone unit 110 is a non-directional and dynamic-type microphone unit. A microphone connector portion 130 to which an output connector 140 is connected is provided in the other end side of the microphone 100. In the microphone 100, a pressure equalization opening 133*a* that allows an inner space of the case 112 and an outer space to communicate is provided in a side surface of the case 112 through a pressure equalization pipe 133.

This microphone 100 has a shape in which rain drops and the like easily enter an opening of the pressure equalization pipe 133, the opening being in contact with outside air, that is, the pressure equalization opening 133*a*. If the rain drops and the like enter the inside of the microphone through the pressure equalization opening 133*a*, corrosion of internal parts is caused, and this becomes a cause of breakdown.

Further, in the microphone 100, the pressure equalization opening 133*a* of the pressure equalization pipe 133 communicates into an outside on a steady basis. If wind or the like is applied to the pressure equalization opening 133*a*, a wind noise easily occurs due to pressure change. Especially, a noise easily occurs with a low frequency component.

The embodiments described in the present application have been invented in view of the foregoing, and have employed a structure that closes a side of a pressure equalization pipe, the side being in contact with outside air, at the time of use, to prevent entry of water drops and occurrence of noises for the non-directional microphone.

Design change can be made for the non-directional microphone according to the present invention without departing from the technical idea described in claims.

What is claimed is:

1. A non-directional microphone comprising:

a housing;

a microphone unit attached to the housing, and including a diaphragm that receives a sound wave; and a connector portion to which a cable connector including a cable that transmits an audio signal from the microphone unit is connectable, wherein a pressure equalization opening that allows a back-side space of the diaphragm in the housing and an outer space to communicate is provided in the connector portion, and the communication between the back-side space of the diaphragm and the outer space through the pressure equalization opening is cut off when the cable connector is connected to the connector portion, and the back-side space of the diaphragm communicates into the outer space through the pressure equalization opening when the cable connector is disconnected from the connector portion.

2. The non-directional microphone according to claim 1, wherein the pressure equalization opening is closed by the cable connector when the cable connector is connected to the connector portion, and the pressure equalization opening is opened when the cable connector is disconnected from the connector portion.

3. The non-directional microphone according to claim 1, wherein the cable connector is brought in contact with the pressure equalization opening when the cable connector is connected to the connector portion.

4. The non-directional microphone according to claim 1, wherein the pressure equalization opening is defined by a pipe which is open ended and which communicates with a back space of the diaphragm.

5. The non-directional microphone according to claim 4, wherein the connector portion includes a connector pin to be connected to the cable connector, and a holding member that holds the connector pin, and the pipe penetrates the holding member and is held by the holding member.

6. The non-directional microphone according to claim 1, wherein the microphone unit is a dynamic microphone unit.

* * * * *